United States Patent [19]

Carlton

[11] Patent Number: 4,798,029

[45] Date of Patent: Jan. 17, 1989

[54] HOLD-DOWN CLAMP

[75] Inventor: Donald G. Carlton, Denton, Tex.

[73] Assignee: Fibergrate Corporation, Dallas, Tex.

[21] Appl. No.: 126,882

[22] Filed: Nov. 30, 1987

[51] Int. Cl.[4] ..... B44D 5/08

[52] U.S. Cl. ..... 52/177; 52/507; 403/387; 248/228

[58] Field of Search ..... 52/177, 665, 698, 703, 52/664, 507; 403/387, 388, 408.1; 119/28; 248/228

[56] References Cited

U.S. PATENT DOCUMENTS

| | | | |
|---|---|---|---|
| 2,572,432 | 10/1951 | Bates | 52/664 X |
| 3,230,931 | 1/1966 | Taylor et al. | 119/28 |
| 3,367,078 | 2/1968 | Thompson, Jr. | 52/507 |
| 3,466,829 | 9/1969 | Robicheaux | 52/507 X |
| 3,742,671 | 7/1973 | Ellis | 52/507 |
| 4,180,343 | 12/1974 | Finlay | 52/507 X |
| 4,362,422 | 12/1982 | Zinkann et al. | 52/507 X |
| 4,408,928 | 10/1983 | Steinke | 403/387 X |
| 4,730,424 | 3/1988 | Green et al. | 52/507 X |

*Primary Examiner*—Carl D. Friedman

*Attorney, Agent, or Firm*—Richards, Harris, Medlock & Andrews

[57] ABSTRACT

An improved hold-down clamp (14) is disclosed for fastening a non-metallic grate (10), preferably formed of fiberglass, to a structural member (12). The clamp (14) includes a restraining clip (20) which prevents spreading of adjacent beams of the grate, and a hold-down clamp (46) which bears on the inner portion of the base of each beam. A threaded fastener (50) urges the hold-down clamp (46) toward the structural member (12), thereby forcing the bases of the beams into engagement with the structural member to clamp the grate to the structural member.

5 Claims, 1 Drawing Sheet

FIG. 1
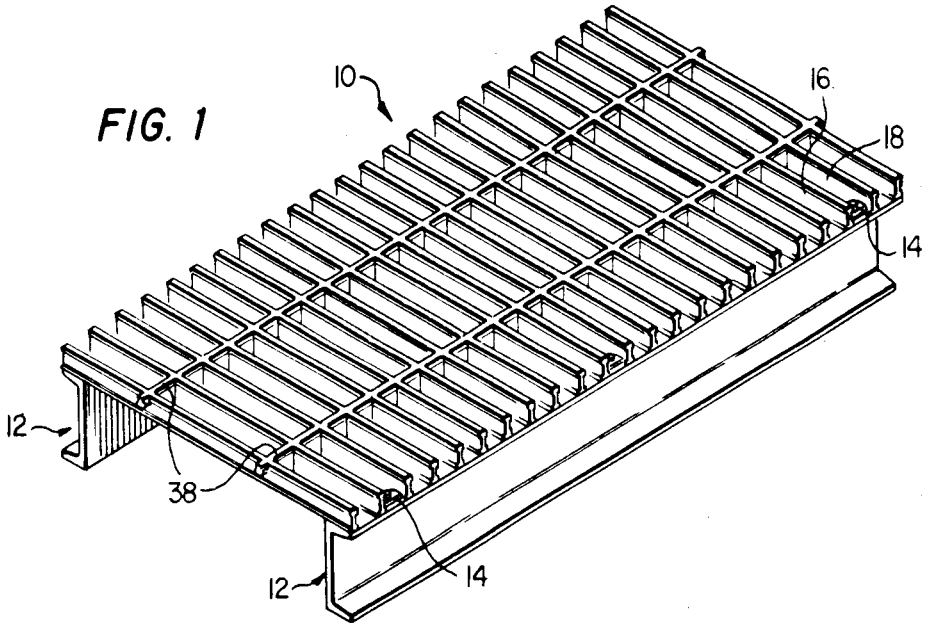
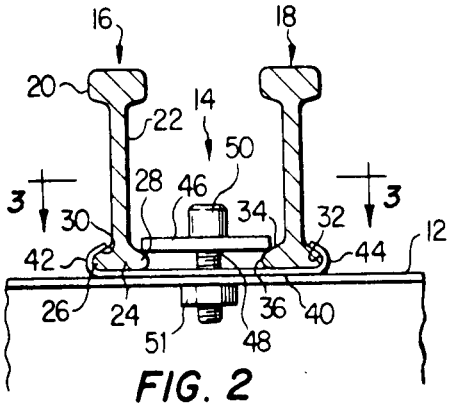
FIG. 2
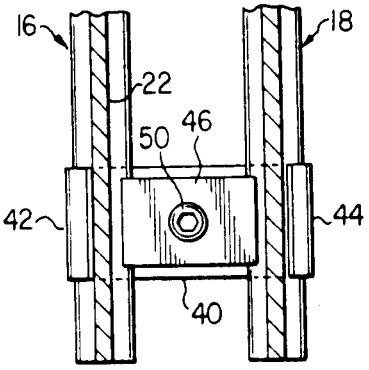
FIG. 3
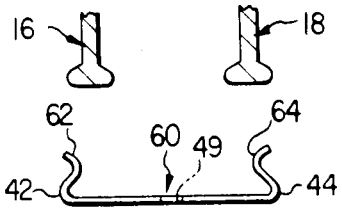
FIG. 4

HOLD-DOWN CLAMP

TECHNICAL FIELD

This invention relates to an improved clamp for securing a fiberglass grating to a structural member.

BACKGROUND OF THE INVENTION

Traditionally, gratings used in industrial applications as walkways and the like have been made of steel. However, non-metallic gratings, particularly those made of fiberglass, have achieved great success in recent years. This success stems from a number of reasons. A fiberglass grating weighs far less than a steel grating. Many environments which would corrode steel have no effect on the fiberglass. Also, fiberglass gratings have great resiliency to absorb shock loading.

Typically a grating, whether steel or fiberglass, will be secured to a structural member by some clamping structure. The design of the fasteners becomes very critical when installing fiberglass gratings because of the particular properties of the fiberglass itself Many fasteners suitable for steel are unsatisfactory for fiberglass, because of its great flexibility.

Fibergrate Corporation, of Dallas, Tex., the assignee of all rights in the present invention, has developed a number of clips for mounting grates on structural members. For example, the type A hold-down clip uses a single U-shape clip with a fastener to mount one beam of a fiberglass grate to a structural member The type M hold-down clip has a double U-shape which simultaneously holds two adjacent beams to a structural member with a single fastener. Other fasteners available in the technology secure adjacent beams of a fiberglass grate, with each beam having a I-beam cross section including a base, to a structural member through the adjacent bases In one design, a wedge shaped member bears on the inner portion of the adjacent bases and is bolted directly to the structural member. In another design, the bases are required to have a flange which parallels the structural member and a bar acts on those flanges to fasten the grate to the structural member.

While several clamping systems available currently for non-metallic gratings are usable, occasionally the load bars of a fiberglass grating will spread or move apart under load when restrained by traditional clamps Therefore a need exists to develop a clamping system which is more compatible with the properties of the materials used in the gratings, particularly fiberglass, while minimizing the cost for the materials of the clamping system, and also minimizing the effort required to install the grate with the clamping system.

SUMMARY OF INVENTION

In accordance with one aspect of the present invention, a clamp is provided for clamping a grate to a structural member. The grate has parallel beams of I-beam cross section, with each beam including a base. The clamp includes a restraining clip extending between a pair of adjacent beams and about the outer portions of the base of each beam. A hold-down clip extends between the pair of beams proximate the restraining clip and contacts the inner portion of the base of each beam. Fastening structure is provided for fastening the grate to the structural member by urging the hold-down clip toward the structural member, and thereby urging the bases of the beams against the structural member. The restraining clip prevents separation of the beams as the grate is clamped to the structural member.

In accordance with another aspect of the present invention, the restraining clip has a protrusion at the end of each portion of the restraining clip extending about the outer portion of the bases to facilitate installation and removal.

BRIEF DESCRIPTION OF THE DRAWINGS

A more complete understanding of the invention may be had by reference to the following Detailed Description, when taken in conjunction with the accompanying drawings, where:

FIG. 1 is a perspective view of a fiberglass grate and a member to which it is secured;

FIG. 2 is a cross sectional view of the installed grate illustrating a clamp forming a first embodiment of the present invention;

FIG. 3 is a plan view of the installed grate of FIG. 2;

FIG. 4 is a cross sectional view of a modified restraining clip used in the clamp illustrated in FIGS. 2 and 3.

DETAILED DESCRIPTION

Referring now to the drawings, wherein like reference characters designate like or corresponding parts throughout the several views, a fiberglass grate 10 is shown secured to a structural member 12 by a clamp 14, forming a first embodiment of the present invention. It will be understood that while the clamp 14 is particularly suitable for installation of fiberglass grates, and grates formed of other non-metallic materials, the clamp 14 could also be used to fasten a conventional steel grate to structural member 12 as well.

With reference now to FIGS. 2 and 3, the fiberglass grate 10 can be seen to include a series of parallel beams, such as beams 16 and 18. The beams have an I-beam cross section, including a top 20, web 22 and base 24. As can be seen in the drawings, the base 24 of each beam has an outer portion 26 and an inner portion 28. The outer portion includes a sloped surface 30 which extends to outer end 32 of the base. Inner portion 28 includes a similar sloped surface 34 which extends to the inner end 36 of the base. Commonly, the separation of adjacent beams will be 1", 1½" or 2". Cross beams 38, formed between beams such as beams 16 and 18, form the structural grid shape.

The clamp 14 includes a restraining clip 40 which extends between the adjacent beams 16 and 18 under the base of each. The ends of the restraining clip 40 are formed by curved portions 42 and 44 which extend about the outer ends 32 of each of the adjacent beams. The restraining clip thereby prevents movement of beams 16 and 18 away from each other.

A hold-down clamp 46 extends between the adjacent beams proximate the restraining clip 40 and bears on the sloped surface 34 on the inner portion 28 of each of the beams. As best seen in FIG. 3, the hold-down clamp 46 has a rectangular cross section in plan view with a hole 48 formed therethrough.

A threaded fastener 50 is inserted from the upper surface of the clamp 46, through hole 48, a hole 49 formed in clip 40, and through an aperture in the structural member 12. A nut 51 is threaded onto the portion of fastener 50 extending through member 12. As the nut 51 is tightened on fastener 50, the fastener will force clamp 46 toward the structural member, in turn exerting a force on the surfaces 34 of each of the beams 16 and 18. The force exerted on the surfaces 34 can be broken into two components, a component parallel the structural member 12, and a component perpendicular the structural member 12. The perpendicular component acts to force the beams 16 and 18 against the structural member to clamp the grate to the structural member. However, the component parallel the structural member tends to spread the beams 16 and 18 apart, which could reduce the clamping force due to the sloped geometry of the surfaces 34. However, the restraining clip 40 prevents this force component from separating the beams, and the clamp 14 thus acts to securely clamp the grating to the structural member.

In one clamp constructed in accordance with the teachings of the present invention for clamping a grate with beams spaced at one and one-half inch centers, the restraining clip was formed of 20 gauge stainless steel having a thickness of 0.035 inches. The width of the clip was approximately 1.375 inches. The hold-down clamp was formed of 11 gauge stainless steel having a thickness of 0.120 inches. The clip had a width of 1.224 inches and a length of 0.724 inches With reference now to FIG. 4, a restraining clip 60, forming a first modification of clip 40, is illustrated. The clip 60 has a number of components identical with clip 40, which identical elements are identified by the same reference numerals as in clip 40. However, clip 60 includes protruded portions 62 and 64 at the end of each curved portion, which extend away from the sloped surface 30 to facilitate installation and removal of the clip from the beams 16 and 18. The protruded portions provide a slight gap between the portions and sloped surface 30, which allows the fingers, or a tool like a screwdriver or the like, to be used to slightly deflect the curved portions outward to snap the curved portions over the outer portions 26 of the beams at the spot to be clamped when installing or removing the clip, and thus eliminate the need to slide a clip over the ends of beams and push the clip along the beams to the spot to be clamped.

While clamp 14 has been illustrated for use with beams of an I-beam cross section, it will be understood that clamp 14 can be effectively used with any beam configuration which permits the tightening of hold down clamp 46 onto the beams to hold restraining clip 40 in place. When held in place, clip 40 keeps the beams, or load bars as they are sometimes referred to, from spreading as the clamp 14 is tightened and when a load is applied to the grating.

Although a single embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A clamp for clamping a grate to a structural member is provided, the grate having parallel beams with a I-beam cross section, comprising:

a restraining clip extending between a pair of adjacent beams and about the outer portion of the base of each beam;

a hold-down clamp extending between the pair of adjacent beams proximate the restraining clip and contacting the inner portion of the base of each beam;

fastening means for fastening the grate to the structural member by urging the hold-down clamp toward the structural member, and thereby urging the bases of the pair of beams against the structural member, the restraining clip preventing separation of the pair of beams.

2. The clamp of claim 1 wherein the restraining clip has a protrusion at the end of each portion of the restraining clip extending about the outer portion of the base to facilitate installation and removal of the restraining clip.

3. The clamp of claim 1 wherein the restraining clip and hold-down clamp each have an aperture formed therethrough, the apertures being aligned during installation to permit passage of said fastening means therethrough.

4. A clamp for clamping a grate to a structural member, the grate having parallel beams with an I-beam cross section, comprising:

a restraining clip extending between a pair of adjacent beams underneath the base of said beams and about the outer end of each base, said restraining clip having an aperture formed therethrough between the beams;

a hold-down clamp having a rectangular shape with a uniform thickness extending between the pair of adjacent beams, an end of said hold-down clamp contacting the inner portion of the base of each of the beams, said restraining clip having an aperture formed therein aligned with the aperture in the restraining clip;

fastening means for extending through the aligned apertures in said restraining clip and hold-down clamp for fastening to the structural member, said fastening means urging the hold-down clamp towards the structural member, and thereby urging the bases of the beams against the structural member, the restraining clip preventing separation of the adjacent beams.

5. The clamp of claim 4 wherein the restraining clip has a protrusion at end each thereof which extends away from the outer end of the bases to facilitate installation and removal of the restraining clip.

* * * * *